United States Patent [19]

Shibatani et al.

[11] Patent Number: 4,528,087

[45] Date of Patent: Jul. 9, 1985

[54] PROCESS FOR PRODUCING MESOPHASE PITCH

[75] Inventors: Haruo Shibatani; Kunimasa Takahashi; Takashi Kameda, all of Ami, Japan

[73] Assignee: Mitsubishi Petrochemical Co., Ltd., Tokyo, Japan

[21] Appl. No.: 473,337

[22] Filed: Mar. 8, 1983

[30] Foreign Application Priority Data

Mar. 9, 1982 [JP] Japan ..... 57-36804
Mar. 10, 1982 [JP] Japan ..... 57-37509

[51] Int. Cl.[3] ..... C10C 3/00

[52] U.S. Cl. ..... 208/22; 208/44; 423/447.2; 423/447.4

[58] Field of Search ..... 208/22, 44

[56] References Cited

U.S. PATENT DOCUMENTS

| | | | |
|---|---|---|---|
| 2,992,181 | 7/1961 | Renner | 208/22 |
| 3,928,170 | 12/1975 | Takahashi et al. | 208/40 |
| 3,970,542 | 7/1976 | Bongertman | 208/22 |
| 3,976,729 | 8/1976 | Lewis et al. | 423/447.6 |
| 4,026,788 | 5/1977 | McHenry | 208/44 |
| 4,184,942 | 1/1980 | Angier et al. | 208/44 |
| 4,209,500 | 6/1980 | Chwastiak | 208/44 |
| 4,391,788 | 7/1983 | Uemura et al. | 208/40 |
| 4,414,096 | 11/1983 | Dickakian | 208/44 |
| 4,460,454 | 7/1984 | Iijima et al. | 208/40 |

FOREIGN PATENT DOCUMENTS

| | | | |
|---|---|---|---|
| 0054437 | 6/1982 | European Pat. Off. | 208/22 |
| 63052 | 10/1982 | European Pat. Off. | 208/22 |

*Primary Examiner*—D. E. Gantz
*Assistant Examiner*—Helane M. Myers
*Attorney, Agent, or Firm*—Oblon, Fisher, Spivak, McClelland & Maier

[57] ABSTRACT

Mesophase pitch containing quinoline soluble mesophase is produced from a pitch having a specific aromatic hydrogen content with a short heat treatment time without conducting any special treatment such as extraction.

8 Claims, No Drawings

PROCESS FOR PRODUCING MESOPHASE PITCH

BACKGROUND OF THE INVENTION

1. Field of the Invention

This invention relates to a process for producing mesophase pitch.

In accordance with this invention, mesophase pitch containing quinoline soluble mesophase may be produced in a short heat treatment time without conducting any special treatment such as extraction.

2. Description of the Prior Art

Most of commercially available carbon fibers are currently produced from polyacrylonitrile fibers. However, they are extremely expensive because the starting material polyacrylonitrile fibers are expensive and the yield of carbon fiber obtained is low. On the other hand, a process utilizing carbonaceous pitch as a starting material has particularly aroused great interest in recent years since the starting material is inexpensive and the yield of carbon fiber is high.

Carbon fiber obtained from an optically isotropic pitch is low both in strength and modulus. In order to obtain a high-strength, high-modulus carbon fiber, it is necessary to subject an isotropic pitch to heat treatment to form mesophase which is a kind of liquid crystal. The pitch containing such mesophase, especially the pitch containing 40% or more of mesophase suitable for the production of high-performance carbon fibers, is called the "mesophase pitch". A representative process for producing mesophase pitch is, as described in Japanese Patent Publication No. 1810/1979, that comprises heating an isotropic pitch at 400° C. for 17 hours, thereby forming about 50% of mesophase. However, almost all mesophase obtained by this process is insoluble in quinoline and pyridine, and therefore the softening point of mesophase pitch was high and hence spinning was difficult.

On the contrary, mesophase pitch containing quinoline soluble mesophase has the advantage that the softening point is low and thus spinning is facilitated, and it has drawn attention as a suitable starting material for high-performance carbon fibers. Examples of the prior art relating to the production of mesophase pitch containing quinoline soluble mesophase are as follows:

In Japanese Patent Application Laid-open No. 160427/1979, a quinoline soluble mesophase is obtained by extracting an isotropic pitch with a solvent and heating the insolubles at 230°-400° C. This is referred to in the present specification as the neomesophase and the solvent insolubles before heating as the neomesophase former or NMF fraction.

Further, in a series of patents, there have been proposed the increase of the NMF fraction in quantity, the improvement of the method for separating the NMF fraction. (see Japanese Patent Application Laid-open Nos. 58287/1980, 130809/1980, 144087/1980, 2388/1981, 109807/1981, 167788/1981 and 2393/1982, respectively).

In Japanese Patent Application Laid-open No. 55625/1979, mesophase pitch containing pyridine soluble mesophase is obtained by heat treating an isotropic pitch at 380°-430° C. with stirring while passing an inert gas thereover. The heating time in this methods is 2-60 hours.

In Japanese Patent Application Laid-open No. 57881/1981, mesophase pitch containing pyridine soluble mesophase is obtained by subjecting a pitch to a physical operation such as extraction with a solvent.

Pitches used in these methods are mainly petroleum pitch and coal tar pitch. It is reported that when producing mesophase pitch containing 40% or more of mesophase from ethylene tar pitch (pitch starting from an ethylene bottom) having properties different from those of these pitches, nothing but that containing more than 60% of pyridine insolubles can be obtained [see S. Chwastiak, I. C. Lewis, Carbon, 16, 156-157, (1978)].

In Japanese Patent Application Laid-open No. 101915/1981, mesophase pitch containing pyridine soluble mesophase is obtained by heat treating a pitch precursor such as ethylene tar at 400°-550° C. under pressure and subsequently heat treating it under atmospheric pressure while passing an inert gas thereover. The heat treatment conditions are similar to those described in Japanese Patent Application Laid-open No. 55625/1979, and have a problem that the heating time is long.

In addition to these known techniques, a method which comprises reacting pitch with tetrahydroquinoline at about 400° C., subsequently heat treating at about 500° C. under reduced pressure for a short time to obtain an isotropic pitch called the premesophase, and obtaining a high-performance carbon fiber therefrom has been published (Nippon Keizai Shinbun dated Aug. 22, 1981). Furthermore, in Japanese Patent Application Laid-open No. 157679/1980, a high purity petroleum pitch is obtained by treating a petroleum residual oil with hydrogen and heat treating it under pressure.

As described above, none of the known techniques were free from problems, for example, a special treatment such as extraction was needed for producing mesophase pitch, the steps were complicated, the treating time was long.

It was previously discovered that when using a catalytically cracked bottom as a starting material and, without any pre-treatment, heat treating it at 430°-550° C. under reduced pressure or while passing an inert gas thereover until at least 40% of mesophase has been formed, mesophase pitch containing quinoline soluble mesophase may be obtained. This pitch may be easily spun to form a high-performance carbon fiber. The present inventors have filed application for patents related thereto (Japanese Patent Application Nos. 24899/1982 and 24900/1982.

However, when a heat treatment similar to that described in these patents was conducted on a pitch, obtained by removing low-boiling distillates from a starting material employed in the process of this invention described hereinbelow, for example, an ethylene bottom, the formed mesophase pitch had a high softening point and thus was not suitable for spinning.

Various kinds of starting material pitches, their properties, further treating conditions of these pitches have been studied, in pursuit of a process of producing high-performance mesophase pitch more advantageous for commercial production than the above-described known techniques. As a result, it has been discovered that by using a specific pitch and conducting a treatment in a high temperature region, which had not been conventionally employed under reduced pressure or while passing an inert gas thereover, a low softening point high-performance mesophase pitch containing quinoline soluble mesophase may be obtained without conducting any special treatment.

SUMMARY OF THE INVENTION

Accordingly, this invention provides a process for producing mesophase pitch which is characterized by heating a pitch having an aromatic hydrogen content of 50–90% at a temperature in the range of 430°–550° C. under reduced pressure and/or while passing an inert gas thereover until at least 40% of mesophase is formed.

The pitches produced by the process of this invention may be used in the production of carbon molded products such as films, sheets, as well as carbon fibers.

DETAILED DESCRIPTION OF THE PREFERRED EMBODIMENTS

As the starting material pitches used in this invention, pitches obtained from a residual oil obtained when pyrolyzing petroleum distillates such as naphtha in a tubular furnace, a residual oil obtained by pyrolysis of heavy oils in a fluidized bed, coal tar are employed. These pitches must have an aromatic hydrogen content of 50–90% relative to the total hydrogens, as measured by nuclear magnetic resonance, on the residue from which distillates having a boiling point at normal pressure of 450° C. or below have been removed or, if said pitch contains solvent insolubles, on that from which such insolubles have been removed beforehand. Therefore, the starting material for the heat treatment may contain distillates of 450° C. or below.

The starting material pitch used in this invention is a pitch having an aromatic hydrogen content of 50–90%, preferably it is a pitch of 55–85% thereof, and more preferably 60–80%. Where the aromatic hydrogen content is lower than 50%, the quinoline insoluble content in the mesophase pitch obtained by the heat treatment is increased, and the softening point is increased and thus spinning becomes difficult, whereas if said content exceeds 90%, the spun pitch fiber has poor reactivity to be rendered infusible and it takes a prolonged time to render it infusible.

Therefore, before conducting the heat treatment according to the process of this invention, if the aromatic hydrogen content is lower than 50% or exceeds 90%, or if it is even within the range of 60–90% but still out of the range of 60–80%, the aromatic hydrogen content may be adjusted beforehand by conducting non-catalytic hydrogen treatment of the starting material pitch as needed. For example, when said hydrogen content is to be increased, the hydrogen treatment may be conducted under the following conditions. The treating temperature is 400°–520° C., preferably 410°–510° C., more preferably 420°–500° C. At a temperature below 400° C., the treatment requires a prolonged time, and further the resulting mesophase pitch has a relatively high softening point and hence spinning becomes difficult. At a temperature higher than 520° C., precipitation of carbonaceous materials becomes remarkable, and thus this is not desirable. The hydrogen partial pressure is generally 5–250 kg/cm$^2$, preferably 10–200 kg/cm$^2$. In addition to hydrogen, gases which do not adversely affect said treatment, for example, low molecular weight hydrocarbons, nitrogen, carbon dioxide, may be present from the initial stage of the hydrogen treatment. While the hydrogen treatment time varies depending on the starting material, the reaction conditions such as the reaction temperature, the hydrogen partial pressure, the desired degree of hydrogen treatment, it is generally 30 seconds to 8 hours, preferably one minute to 7 hours, and more preferably 2 minutes to 6 hours.

Said treatment may be conducted either in a continuous manner or in a batchwise manner.

The hydrogen treatment in accordance with the present invention is especially effective on a residual oil formed during production of ethylene by pyrolysis of petroleum fractions at 700°–1000° C. (ethylene bottom). The term "petroleum fractions" as herein used means distillates such as naphtha, light oil, residues, crude oils, and products obtained by subjecting them to treatment such as hydrogenolysis and hydrodesulfurization. The residual oils may be employed in the form of tar containing liquid distillates or may be employed in the form of pitch by distilling off the liquid distillates, or even the liquid distillates may also be employed alone. The aforesaid ethylene bottom has a particularly low content of impurities such as sulfur as compared with the catalytically cracked bottom and coal pitch and thus is preferred as a starting material for high purity carbonaceous materials, although the present process may also be applied to the catalytically cracked bottom.

The hydrogen treatment employed in the process of this invention involves a sort of hydrogenolysis or hydrodealkylation, thereby the proportion of the aromatic hydrogens is adjusted. It is also presumed that at the same time the purity is also enhanced by the hydrogenation of the olefinic double bonds, the decomposition of the impurities containing sulfur or oxygen. In other words, it is presumed that although the starting material as such for producing mesophase pitch containing quinoline soluble mesophase has too high of a proportion of aliphatic side chains and/or alicyclic moieties, it is converted, by enhancing the aromaticity by the hydrogen treatment, into a starting material having an appropriately adjusted aromatic hydrogen ratio. Such a starting material has a composition for forming high-performance mesophase pitch excellent in the balance between spinnability of the mesophase pitch produced therefrom and reactivity to be rendered infusible of the spun pitch fiber (speed to be rendered infusible). Therefore, it is presumed that a higher temperature is required as compared with the process in Japanese Patent Application Laid-open No. 157679/1980 which chiefly aims to obtain a good needle coke starting material by removing impurities in an ethylene bottom.

The heat treatment in accordance with this invention is conducted in the temperature range of 430°–550° C., preferably 440°–530° C., and more preferably 450°–510° C. Although the temperature for the heat treatment could be higher than 550° C., mesophase pitch is formed within an extremely short time and if the heat treatment is extended at that temperature, the quinoline insolubles content in said mesophase pitch suddenly increases. Hence, the production of carbon fiber utilizing this mesophase pitch becomes difficult, and thus this is not preferred. On the contrary, with the heat treatment temperature lower than 430° C., it takes a prolonged time to form mesophase and thus this is not desirable.

While the time required for the heat treatment varies depending on the starting material pitch, the heat treatment temperature, 10 seconds–150 minutes is generally employed, preferably 1–120 minutes, and more preferably 2–100 minutes.

In the process of this invention, the above heat treatment is conducted under reduced pressure and/or while passing an inert gas thereover. With respect to reduced pressure conditions, a pressure of 0.1–150 mm Hg is generally employed, preferably 1–50 mm Hg. In such a case, it is desirable to effect it while stirring the material pitch, but it is not essential. As said inert gas, there may be employed, in addition to nitrogen and argon, for example, hydrogen, hydrocarbons which are gaseous at room temperature such as methane, ethane, hydrocarbons which become gaseous at least at the heat treatment temperature, steam. The amount to be passed is 200–5000 1/hr, preferably 400–3000 1/hr, per kg of the starting material pitch.

High-performance mesophase pitch is obtained by the process of this invention, but its formation mechanism has not been clarified. Whatever it may be, it is necessary to heat at a specific temperature under reduced pressure and/or while passing an inert gas thereover, and a process which satisfies only one of these conditions cannot provide high-performance mesophase pitch.

Further, although in this invention the heat treatment is conducted while passing the aforesaid inert gas thereover, it is also possible to remove the inert gas while conducting the heat treatment, evacuate the system and continue the heat treatment under reduced pressure. Further, the process of this invention may be conducted while stirring the starting material pitch, but it is not essential.

In the mesophase pitch obtained by the process of this invention, mesophase is contained 40–100%, preferably 70–100%, and more preferably 90–100%. If the mesophase content is lower than 70%, especially if it is lower than 40%, spinning of said pitch is difficult, and performance of the obtained carbon fiber deteriorates. The content of mesophase is determined by polarized light microscopy observation at room temperature and indicates the proportion of the area of the anisotropic part relative to the entire area within the range of the polarized light microscope of said mesophase pitch (containing both isotropic and anisotropic parts). Further, the quinoline insolubles content is 60% or less, preferably 40% or less, and more preferably 30% or less. The higher the proportion of the quinoline insolubles content, the higher the spinning temperature, the more frequently the deterioration of the pitch on spinning occurs, and the lesser the spinning speed becomes.

The mesophase pitch obtained by the process of this invention generally has a softening point of 350° C. or below and can be easily spun.

The mesophase pitch obtained by the process of this invention may be spun by a known melt spinning method. While the spinning temperature depends on the viscosity characteristics of the pitch, for example, 300°–450° C. is employed. The spinning speed is 50–1000 m/min., although it is possible to spin at a higher speed. By this, a pitch fiber of about 5–about 15 μm may be obtained. The pitch fiber is subsequently treated to be rendered infusible in an oxidative atmosphere such as an oxygen containing gas for example at 250°–400° C. for about 5–about 60 minutes, and then carbonized in an inert gas atmosphere such as nitrogen, argon, for example, at 900°–2000° C. for about 0.5--about 30 minutes. If desired, it may further be treated in the aforesaid inert gas atmosphere at 2500°–3300° C. to make a graphite fiber. Further, in the aforesaid respective treatments, it is also possible to employ known improved methods (for example those methods disclosed in Japanese Patent Application Laid-open Nos. 6547/1980, 101916/1981).

Having generally described this invention, a further understanding can be obtained by reference to certain specific examples which are provided herein for purposes of illustration only and are not intended to be limiting unless otherwise specified.

Example 1

A pitch was obtained from an ethylene bottom produced by pyrolysis of naphtha (the boiling point at normal pressure being 170° C. or above) by removing the distillates having a boiling point at normal pressure of 470° C. or below therefrom by distillation. The nuclear magnetic resonance of this pitch was measured to determine the aromatic hydrogen content. The measurement was done using a (JEOL) nuclear magnetic resonance spectrometer, model FX-270 (resonance frequency 270 mHz) in a carbon disulfide solvent and at a sample concentration of 5% by weight. The assignment of the chemical shift was done based on Fuel, 60, (1981), pp. 221–231, Table 2 (ibld. p. 224), and a chemical shift region of 9.30–6.30 ppm from the tetramethylsilane standard was assigned to the aromatic hydrogens. The proportion of the aromatic hydrogens in the aforesaid region of 9.30–6.30 ppm from the tetramethylsilane relative to the total hydrogens was 45%.

73 g of the aforesaid ethylene bottom (the boiling point at normal pressure being 170° C. or above) was charged into an autoclave of 120 ml capacity, which was then pressurized to 70 kg/cm$^2$ with hydrogen. The temperature was raised from room temperature to 460° C. over 120 minutes and maintained at that temperature for 80 minutes to effect a reaction, during which the maximum pressure reached 155 kg/cm$^2$. After cooling to room temperature, the contents were removed and distilled to remove the distillates having a boiling point at normal pressure of 460° C. or below, thereby a pitch was obtained at a yield of 20% based on the starting material ethylene bottom. The aromatic hydrogen content of the pitch after the hydrogen treatment as measured by nuclear magnetic resonance was 72%.

After the hydrogen treatment, 5.0 g of the aforesaid pitch was charged into a reactor of 40 ml capacity and dipped into a fused salt bath previously maintained at 490° C. in an argon stream. As a temperature of 485° C. was reached in about 4 minutes after starting to dip, the pressure inside the reaction system was made 10 mm Hg, and heat treatment was conducted under the same conditions for 13 minutes. As a result, a heat treatment pitch was obtained at a yield of 75% based on the charged pitch after the hydrogen treatment. The obtained pitch had a softening point as examined on a microscope equipped with heating stages of 305° C., a mesophase content of 95% and a quinoline insolubles content by JIS K 2425 centrifugation method of 10%.

Comparison 1

10 g of a pitch obtained by removing the distillates having a boiling point at normal pressure of 470° C. or below from the ethylene bottom of Example 1 by distillation was charged into a reactor of 40 ml capacity, and heat treated similarly as in Example 1 under conditions of a temperature of 485° C., a pressure of 13 mm Hg and a time of 10 minutes. As a result, the yield of the pitch was 60%, its softening point was 440° C., its mesophase content was 95% and its quinoline insolubles content was 91%.

Examples 2–9

Reactions were effected by changing the conditions for the hydrogen treatment and heat treatment in the experiment in Example 1 to those set forth in Table 1, respectively. In the distillation after the hydrogen treatment, however, the distillates having a boiling point at normal pressure of 500° C. or below were removed. Further, in the heat treatment, the fused salt bath temperature was made about 5° C. higher than the reaction temperature. The system was evacuated four minutes after starting to dip the reactor into the salt bath, and the period after that point was regarded as the heat treatment time. The obtained results were as shown in Table 1.

TABLE 1

| | Hydrogen Treatment | | | | | | Pitch after Hydrogen Treatment |
|---|---|---|---|---|---|---|---|
| Example | Temperature (°C.) | Time to Raise Temperature (°C.) | Residence Time (min) | Charging Pressure (kg/cm²) | Maximum Pressure (kg/cm²) | Pitch Yield after Distillation[a] (% by weight) | Aromatic Hydrogen Content (%) |
| 2 | 420 | 120 | 60 | 80 | 148 | 19 | 55 |
| 3 | 440 | 125 | 60 | 70 | 135 | 17 | 59 |
| 4 | 440 | 123 | 20 | 70 | 129 | 19 | 56 |
| 5 | 440 | 18 | 60 | 70 | 117 | 18 | 59 |
| 6 | 460 | 129 | 80 | 20 | 96 | 22 | 67 |
| 7 | 460 | 24 | 10 | 70 | 130 | 17 | 57 |
| 8 | 480 | 20 | 10 | 60 | 141 | 22 | 61 |
| 9 | 500 | 42 | 10 | 60 | 160 | 18 | 73 |

| | Heat Treatment | | | | Properties of Formed Pitch | | |
|---|---|---|---|---|---|---|---|
| Example | Temperature (°C.) | Pressure (mm Hg) | Time (min) | Pitch Yield[b] (% by weight) | Softening Point (°C.) | Mesophase Content (%) | Quinoline Insolubles Content (% by weight) |
| 2 | 455 | 4 | 15 | 64 | 310 | 70 | 24 |
| 3 | 480 | 10 | 4 | 75 | 320 | 90 | 24 |
| 4 | 485 | 10 | 5 | 74 | 320 | 80 | 40 |
| 5 | 480 | 10 | 7 | 78 | 315 | 80 | 43 |
| 6 | 480 | 10 | 9 | 83 | 320 | 90 | 25 |
| 7 | 480 | 10 | 7 | 82 | 340 | 95 | 50 |
| 8 | 485 | 10 | 7 | 70 | 325 | 95 | 46 |
| 9 | 480 | 10 | 11 | 78 | 290 | 95 | 20 |

[a]Based on the starting material ethylene bottom
[b]Based on the heat treatment starting material pitch Example 10

10 g of chloroform solubles of coal pitch (the aromatic hydrogen content as measured similarly as in Example 1 being 85%) was charged into a reactor of 40 ml capacity and heat treated similarly as in Example 1 under conditions of a temperature of 490° C., a pressure of 10 mm Hg and a time of 15 minutes. As a result, the yield of the pitch obtained was 34%, its softening point was 300° C., its mesophase content was 60% and its quinoline insolubles content was 20%.

Reference 1

The pitch obtained in Example 1 was melt spun at 408° C. using a spinneret of a hole diameter of 0.5 mm at 420 m/min. Thereafter, the temperature was raised to 270° C. in air atmosphere over 3.5 hours, and maintained at that temperature for 45 minutes to render it infusible. Then, it was further heated at 1000° C. in an argon stream at a rate of 5° C./min. to obtain a carbon fiber. The obtained fiber had a diameter of 10 μm and showed anisotropy oriented in the axis direction by polarized light microscopy examination. Its tensile strength was 248 kg/mm² and the modulus was 14000 kg/mm².

References 2–10

The mesophase pitches containing quinoline soluble mesophase obtained in Examples 2–10 were respectively melt spun using a spinneret of a hole diameter of 0.5 mm. The spinning temperatures and the spinning speeds were as shown in Table 2.

TABLE 2

| Reference | Mesophase Pitch Used for Spinning | Spinning Temperature (°C.) | Spinning Speed (m/min) |
|---|---|---|---|
| 2 | Obtained in Example 2 | 420 | 100 |
| 3 | Obtained in Example 3 | 426 | 230 |
| 4 | Obtained in Example 4 | 440 | 140 |
| 5 | Obtained in Example 5 | 440 | 230 |
| 6 | Obtained in Example 6 | 420 | 420 |
| 7 | Obtained in Example 7 | 440 | 150 |
| 8 | Obtained in Example 8 | 430 | 250 |
| 9 | Obtained in Example 9 | 390 | 420 |
| 10 | Obtained in Example 10 | 390 | 420 |

Example 11

72 g of the ethylene bottom used in Example 1 (the boiling point at normal pressure being 170° C. or above) was charged into an autoclave of 120 ml capacity, which was then pressurized to 70 kg/cm² with hydrogen. The temperature was raised from room temperature to 450° C. over 100 minutes and maintained at that temperature for 80 minutes to effect a reaction, during which the maximum pressure reached 150 kg/cm². After cooling to room temperature, the contents were removed and distilled to remove the distillates having a boiling point at normal pressure of 470° C. or below. Thereby a pitch was obtained at a yield of 18% based on the starting material ethylene bottom. The aromatic hydrogen content of the pitch after the hydroen treatment as measured by nuclear magnetic resonance was 63%.

After the hydrogen treatment, 10 g of the aforesaid pitch was charged into a reactor of 40 ml capacity and dipped into a fused salt bath previously maintained at 490° C. in an argon stream. As a temperature of 485° C. was reached in about 4 minutes after starting to dip, heat treatment was conducted while passing argon at a rate of 24 1/hr for 8 minutes under the same conditions. As a result, a heat treated pitch was obtained at a yield of 72% based on the charged pitch after the hydrogen treatment. The obtained pitch had a softening point as examined on a microscope equipped with heating stages of 295° C., a mesophase content of 80% and a quinoline insolubles content by JIS K 2425 centrifugation method of 22%.

EXAMPLES 12–16

Experiments similar to Example 11 were conducted except that the conditions for the hydrogen treatment and heat treatment were changed to those set forth in Table 1. Moreover, in the distillation after the hydrogen treatment, the distillates having a boiling point at normal pressure of about 500° C. or below were removed, and in the heat treatment, the fused salt bath temperature was made about 5° C. higher than the reaction temperature. Further, 4 minutes after starting to dip the reactor into said salt bath, the argon gas flow began. The results obtained were as given in Table 3.

References 11–16

The pitches obtained in Examples 11–16 were spun using a spinneret of a hole diameter of 0.5 mm. The spinning temperature and the spinning speeds were as shown in Table 4.

With the pitch fiber obtained by melt spinning in Reference 11, the temperature was thereafter raised to 270° C. in air atmosphere over 3.5 hours and maintained at that temperature for 45 minutes to render this fiber infusible. Then, it was further heated to 1000° C. in an argon stream at a rate of 5° C. min. to obtain a carbon fiber. The obtained fiber had a diameter of 11 μm and showed anisotropy oriented in the axis direction by polarized light microscopy examination. Its tensile strength was 210 kg/mm$^2$ and the modulus was 13000 kg/mm$^2$.

TABLE 3

| | Hydrogen Treatment | | | | | | Pitch after Hydrogen Treatment |
|---|---|---|---|---|---|---|---|
| Example | Temperature (°C.) | Time to Raise Temperature (°C.) | Residence Time (min) | Charging Pressure (kg/cm$^2$) | Maximum Pressure (kg/cm$^2$) | Pitch Yield after Distillation[a] (% by weight) | Aromotic Hydrogen Content (%) |
| 12 | 460 | 120 | 80 | 70 | 155 | 20 | 72 |
| 13 | 440 | 123 | 20 | 70 | 129 | 19 | 56 |
| 14 | 460 | 129 | 80 | 20 | 96 | 22 | 67 |
| 15 | 480 | 20 | 20 | 60 | 141 | 22 | 61 |
| 16 | 500 | 42 | 42 | 60 | 160 | 18 | 73 |

| | Heat Treatment | | | | Properties of Formed Pitch | | |
|---|---|---|---|---|---|---|---|
| Example | Temperature (°C.) | Rate of Argon Passed (1/hr) | Time (min) | Pitch Yield[b] (% by weight) | Softening Point (°C.) | Mesophase Content (%) | Quinoline Insolubles Content (% by weight) |
| 12 | 485 | 24 | 10 | 71 | 300 | 95 | 12 |
| 13 | 485 | 20 | 8 | 73 | 330 | 100 | 50 |
| 14 | 480 | 24 | 9 | 75 | 325 | 95 | 25 |
| 15 | 485 | 24 | 8 | 71 | 320 | 95 | 40 |
| 16 | 480 | 25 | 10 | 74 | 290 | 95 | 22 |

[a]Based on the starting material ethylene bottom
[b]Based on the heat treatment starting material pitch

TABLE 4

| Reference | Mesophase Pitch Used for Spinning | Spinning Temperature (°C.) | Spinning Speed (m/min) |
|---|---|---|---|
| 11 | Obtained in Example 11 | 388 | 320 |
| 12 | Obtained in Example 12 | 390 | 420 |
| 13 | Obtained in Example 13 | 440 | 150 |
| 14 | Obtained in Example 14 | 410 | 420 |
| 15 | Obtained in Example 15 | 430 | 200 |
| 16 | Obtained in Example 16 | 390 | 420 |

Having now fully described this invention, it will be apparent to one of ordinary skill in the art that many changes and modifications can be made thereto without departing from the spirit or scope of the invention as set forth herein.

What is claimed as new and desired to be secured by Letters Patent of the United States is:

1. A process for producing mesophase pitch wherein about 40% or more of the mesophase in said pitch is quinoline soluble mesophase, which consists of heating a pitch having an aromatic hydrogen content of 50–90% at a temperature in the range of 430°–550° C. while passing an inert gas thereover until at least 40% of mesophase is formed.

2. The process for producng mesophase pitch according to claim 1 wherein 60% or more of the mesophase contained in the mesophase pitch is quinoline soluble mesophase.

3. The process for producing mesophase pitch according to claim 1 wherein 70% or more of the mesophase contained in the mesophase pitch is quinoline soluble mesophase.

4. The process for producing mesophase pitch according to claim 1 wherein said mesophase pitch comprises 70–100% of mesophase.

5. The process for producing mesophase pitch according to claim 1 wherein said mesophase pitch comprises 90–100% of mesophase.

6. The process for producing mesophase pitch according to claim 1 wherein the pitch having an aromatic hydrogen content of 50–90% is produced by heating at a temperature of 400°–520° C. in the presence of hydrogen at a pressure of 5–250 kg/cm$^2$, a residual oil obtained by the decomposition of petroleum fractions.

7. The process for producing mesophase pitch according to claim 6 wherein the residual oil is that formed when producing ethylene by the pyrolysis of petroleum fractions at 700°–1000° C.

8. A process for producing mesophase pitch wherein about 40% or more of the mesophase in said pitch is quinoline soluble mesophase, which consists of heating a pitch having an aromatic hydrogen content of 50–90% at a temperature in the range of 430°–550° C. under reduced pressure until at least 40% of mesophase is formed.

* * * * *